United States Patent [19]

Welch et al.

[11] 4,323,595

[45] * Apr. 6, 1982

[54] NICKEL-MOLYBDENUM CATHODE

[75] Inventors: Cletus N. Welch, Clinton; John O. Snodgrass, Akron, both of Ohio

[73] Assignee: PPG Industries, Inc., Pittsburgh, Pa.

[ * ] Notice: The portion of the term of this patent subsequent to Feb. 17, 1998, has been disclaimed.

[21] Appl. No.: 117,414

[22] Filed: Jan. 31, 1980

Related U.S. Application Data

[62] Division of Ser. No. 6,068, Jan. 24, 1979, Pat. No. 4,248,679.

[51] Int. Cl.[3] ..... B05D 1/08; B05D 5/12

[52] U.S. Cl. ..... 427/123; 427/271; 427/273; 427/423; 252/477 Q; 204/290 R; 427/336

[58] Field of Search ..... 427/423, 126, 123, 273, 427/271, 336; 204/290 R, 98, 128; 252/293, 477 Q

[56] References Cited

U.S. PATENT DOCUMENTS

| | | | |
|---|---|---|---|
| 3,674,710 | 7/1972 | Richter et al. | 252/477 Q X |
| 4,024,044 | 5/1977 | Brannan et al. | 204/242 |
| 4,033,837 | 7/1977 | Kuo et al. | 204/98 |
| 4,049,580 | 9/1977 | Oden et al. | 252/477 Q X |
| 4,049,841 | 9/1977 | Coker et al. | 427/423 |
| 4,080,278 | 3/1978 | Ravier et al. | 204/242 |
| 4,153,578 | 5/1979 | DeThomas | 252/477 Q X |
| 4,251,478 | 2/1981 | Welch et al. | 427/123 |

FOREIGN PATENT DOCUMENTS

| | | | |
|---|---|---|---|
| 49-46523 | 12/1974 | Japan | 427/423 |

*Primary Examiner*—Shrive P. Beck

*Attorney, Agent, or Firm*—Richard M. Goldman

[57] ABSTRACT

Disclosed herein is a cathode having an electroconductive substrate and a porous surface. The porous surface is characterized by containing a major portion of nickel and a hydrogen overvoltage reducing amount of molybdenum. The molybdenum may be present as elemental molybdenum, as an alloy with nickel, or as a molybdenum compound. Also disclosed is an electrolytic cell having an anode, a cathode, and a separator between the anode and cathode, where the cathode is characterized by a porous surface having a major portion of nickel and a hydrogen over voltage reducing amount of molybdenum, which molybdenum may be present as elemental molybdenum, and molybdenum alloy with nickel or a molybdenum compound.

Further disclosed is a method of electrolyzing an alkali metal chloride brine by passing an electrical current from an anode to a cathode to evolve chlorine at the anode and hydroxyl ion at the cathode. The cathode is characterized by a porous surface containing a major portion of nickel and hydrogen overvoltage reducing amount of molybdenum.

Also disclosed is a method of preparing a porous nickel electrode by flame spraying nickel bearing particles, leachable constituent bearing particles and molybdenum bearing particles onto a metal substrate and leaching out the leachable constituent whereby to form the porous surface.

5 Claims, No Drawings

NICKEL-MOLYBDENUM CATHODE

This is a division of application Ser. No. 6,068, filed Jan. 2:, 1979, now U.S. Pat. No. 4,248,679.

DESCRIPTION OF THE INVENTION

Alkali metal hydroxide and chlorine are commercially produced by electrolyzing an alkali metal chloride brine, for example an aqueous solution of sodium chloride or an aqueous solution of potassium chloride. The alkali metal chloride solution is fed into the anolyte compartment of an electrolytic cell, a voltage is imposed across the cell, chlorine is evolved at the anode, alkali metal hydroxide is evolved in the electrolyte in contact with the cathode, and hydrogen is evolved at the cathode.

The overall anode reaction is:

$$Cl^- \rightarrow \tfrac{1}{2}Cl_2 + e^- \quad (1)$$

while the overall cathode reaction is:

$$H_2O + e^- \rightarrow \tfrac{1}{2}H_2 + OH^- \quad (2)$$

More precisely the cathode reaction is reported to be:

$$H_2O + e^- \rightarrow H_{ads} + OH^- \quad (3)$$

by which the monatomic hydrogen is adsorbed onto the surface of the cathode. In alkaline media, the adsorbed hydrogen is reported to be desorbed from the cathode surface according to one of two processes:

$$2H_{ads} \rightarrow H_2, \text{ or} \quad (4)$$

$$H_{ads} + H_2O + e^- \rightarrow H_2 + OH^- \quad (5)$$

The hydrogen desorption step, that is either reaction (4) or reaction (5) is reported to be the hydrogen overvoltage determining step. That is, it is the rate controlling step and its activation energy bears a relationship to the cathodic hydrogen overvoltage. The hydrogen evolution potential for the overall reaction (2) is on the order of about 1.5 to 1.6 volts measured against a saturated calomel electrode (SCE) on iron in alkaline media. Approximately 0.4 to 0.5 volt represents the hydrogen overvoltage on iron while 1.11 volts is the equilibrium decomposition voltage.

Iron, as used herein to characterize cathodes includes elemental iron such as carbon steels, and alloys of iron with manganese, phosphorus, cobalt, nickel, molybdenum, chromium, vanadium, palladium, titanium, zirconium, niobium, tantalum, tungsten, carbon and the like.

As disclosed herein, it has been found that the hydrogen over-voltage may be reduced, for example, to from about 0.04 volt to about 0.20 volt by utilizing a cathode having a conductive substrate and a porous catalytic surface of nickel containing an effective amount of either molybdenum or an alkali-resistant molybdenum compound or both for example, elemenal molybdenum, an alloy of molybdenum and nickel, molybdenum carbide, molybdenum boride, molybenum nitride, molybdenum sulfide, or molybdenum oxide.

According to a still further exemplification of this invention, it has been found that a particularly desirable electrolytic cell may be provided having an anode, a cathode, and permionic membrane therebetween to separate the anolyte compartment from the catholyte compartment, wherein the cathode is characterized by a conductive substrate, a porous catalytic surface of nickel, and an effective amount of molybdenum or a molybdenum compound in the porous nickel surface, where the molybdenum compound is as described above.

According to a still further exemplification of this invention, it is possible to electrolyze alkali metal halide brines by feeding the alkali metal halide brine to the anolyte compartment, evolving the halogen at the anode, and hydroxyl ion at the cathode, where the cathode is characterized by a conductive substrate, with a porous catalytic surface of nickel on the substrate, which porous catalytic surface being further characterized by the presence of an effective amount of either molybdenum or an alkali metal hydroxide-resistant molybdenum compound as described above.

According to a still further exemplification of the method of this invention, a cathode is prepared having an electro-conductive substrate with a porous nickel catalyst containing an effective amount of molybdenum compound therein by flame spraying nickel bearing particles, as alloys or as the separate elements, leachable constituent bearing particles, and molybdenum bearing particles as alloys or as the substrate elements, onto a metal substrate and leaching out the leachable constituent whereby to form a porous surface.

By an effective amount of molybdenum or a molybdenum compound is meant an amount that is sufficient to either reduce the initial over-voltage of the porous nickel surface, or to maintain the low overvoltage of the porous nickel surface at a low value after extended periods of electrolysis, or to both reduce the initial overvoltage of the porous nickel surface and to maintain a low overvoltage over extended periods of electrolysis.

DETAILED DESCRIPTION OF THE INVENTION

As contemplated herein, the cathode comprises an electro-conductive substrate having porous nickel surface, which porous nickel surface contains an effective amount, i.e., an overvoltage reducing or overvoltage stabilizing amount of either molybdenum or an alkali-resistant molybdenum compound or both.

The substrate is typically an iron substrate. As used herein, iron includes elemental iron, iron alloys, such as carbon steels, and alloys of iron with manganese, phosphorus, cobalt, nickel, chromium, molybdenum, vanadium, palladium, titanium, zirconium, niobium, tantalum, tungsten, carbon, and the like. However, the electro-conductive substrate may also be an electro-conductive metal such as aluminum, copper, lead, or the like, having a suitable alkali-resistant surface thereon. Alternatively, the substrate can be cobalt, nickel, molybdenum, tungsten, or other alkali resistant metal. According to one particularly preferred exemplification, the electroconductive substrate has a nickel surface thereon whereby to protect the substrate from attack by concentrated alkali metal hydroxide catholyte liquors.

According to one particularly desirable exemplification of the invention, the substrate, especially an iron substrate, has a thin coating, for example, a coating of from about 20 to about 125 micrometers of nickel whereby to provide a barrier for corrosive attack of the substrate and to prevent undermining of the porous surface by the catholyte liquor.

The substrate itself is macroscopically permeable to the electrolyte but microscopically impermeable thereto. That is, the substrate is permeable to the bulk flow of electrolyte through individual elements thereof such as between individual rods or wires or through perforations, but not to the flow of electrolyte into and through the individual elements thereof. The cathode itself may be a perforated sheet, a perforated plate, metal mesh, expanded metal mesh, metal rods, or the like.

The catalytic surface has a Brunnauer-Emmett-Teller surface area of from about 1 to about 100 square meters per gram, and a porosity of the active surface of from about 0.5 to about 0.9.

The surface itself is characterized by pores, fissures, peaks, and valleys. Generally, when examined under a scanning electron microscope, the surface appears as having been formed by partially molten or deformable particles impacted against the substrate which partially molten or deformable particles are thereafter leached.

The porous catalytic surface has a hydrogen evolution voltage less than about 1.21 volts versus a saturated calomel electrode and 0.97 volt versus a normal hydrogen electrode at 200 Amperes per square foot in aqueous alkaline media.

The surface comprises nickel and molybdenum. The nickel is generally above about 50% and less than about 95%, and generally from about 65 to about 90 percent nickel, calculated as nickel metal, basis total weight of the porous active surface.

The molybdenum is present in the porous catalytic surface in a hydrogen overvoltage lowering amount. This is above about 2.5%, preferably above about 5%, but below about 50%, and generally from about 10 to about 35 weight percent, calculated as molybdenum metal, basis total nickel calculated as metal and molybdenum calculated as metal in the surface. Generally, the amount of molybdenum in the surface is high enough to have a hydrogen overvoltage lowering effect, but low enough to avoid the high overvoltage identified with porous surfaces that are mainly molybdenum.

While the mechanism of the hydrogen over voltage lowering effect of the molybdenum is not clearly understood, it is known that porous molybdenum alone is high in hydrogen overvoltage, but that a low hydrogen overvoltage over extended periods of electrolysis is observed when molybdenum is used in conjunction with porous nickel. The molybdenum is believed to depolarize or catalyze one step of the hydrogen evolution process. For this reason, the upper limit of the molybdenum is below the concentration at which the surface has the hydrogen overvoltage properties of molybdenum, i.e. below about 50 percent and generally below about 35 percent.

The molybdenum itself may be present as elemental molybdenum, that is as molybdenum having a formal valence of 0, as an alloy with nickel or as a alkali-resistant compound such as molybdenum carbide, molybdenum nitride, molybdenum boride, molybdenum sulfide, molybdenum phosphide, molybdenum oxide, or any molybdenum compound that is insoluble in concentrated alkali metal hydroxide. Preferably, the molybdenum is present as elemental molybdenum, a molybdenum alloy with nickel, or molybdenum carbide.

One particularly outstanding cathode of this invention is one having a perforated iron plate substrate, a thin layer of electro deposited nickel about 20 to about 125 micrometers thick, and a porous surface of nickel and molybdenum containing about 82 weight percent nickel, and about 18 weight percent molybdenum basis total nickel and molybdenum and having a porosity of about 0.7 and a thickness of about 75 to about 500 micrometers.

According to a further exemplification of the method of this invention, the cathode herein contemplated is prepared by depositing a film of nickel, molybdenum, and a leachable material, and thereafter leaching out the leachable material.

The leachable material may be any metal or compound that can be co-deposited with nickel and molybdenum or with nickel compounds and molybdenum compounds and leached out by a strong acid or strong base without leaching out significant quantities of the nickel or molybdenum or causing significant deterioration or poisoning of the nickel or molybdenum.

The film may be deposited by flame spraying particles of nickel, molybdenum, and leachable materials, or electrodeposition of nickel, molybdenum, and leachable material, or by codeposition of solid particles and an electrodeposited film which film attaches the particles to the substrate, or by chemical deposition for example, by hypophosphite deposition or by tetraborate deposition of nickel compounds, molybdenum compounds, and leachable materials, or even by deposition and thermal decomposition of organic compounds of nickel, molybdenum, and leachable materials, for example, deposition and thermal decomposition of alcoholates or resinates.

According to one particularly desirable exemplification, of the method of preparing the electrode of this invention, fine particles for example on the order of about 0.5 to 70 micrometers in diameter, of nickel, molybdenum or a molybdenum compound, and leachable material are impacted against the substrate at a temperature high enough to cause some deformation of the particle and adherance of the particle to the electro conductive substrate.

The leachable materials may be present in the particle with the nickel or may be separate particles. Typical leachable compounds include copper, zinc, gallium, aluminum, tin, silicon or the like. Especially preferred for flame spray deposition are nickel particles containing about 30 to about 70 percent nickel, balance aluminum, as Raney alloy. In the exemplification of the method of this invention, where Raney alloy is flame sprayed against the porous substrate, the temperature of the flame spray is about 2200 to about 3100 degrees Centigrade whereby to provide deformable particles which adhere strongly to the substrate. The temperatures herein contemplated may be provided by a flame spray of oxygen and acetylene or oxygen and hydrogen.

The flame spray continues to build up individual coats, to a total thickness from about 10 to about 50 micrometers in order to obtain a total thickness from about 75 to about 500 micrometers. Thereafter, the surface is leached in alkali, such as 0.5 normal caustic soda or 1 normal caustic soda, in order to remove aluminum, and thereafter rinsed with water. It is, of course to be understood that some of the leachable material may remain in the porous electrode surface without deleterious effect. Thus, for example, where Raney nickel-aluminum alloy, and molybdenum are flame sprayed, the surface may contain nickel, molybdenum, and aluminum, after leaching. The resulting surface, may, for example, contain amorphous nickel, crystalline molybdenum, nickel-aluminum alloys, and traces of alumina.

According to a particularly desirable method of this invention, the leached nickel-molybdenum bearing substrate is annealed at a temperature of above about 200° C. and below temperatures dictated by the thermal expansion differentials of the substrate and porous surface, for example between about 200° C. and 600° C. in a suitable nonoxidizing atmosphere such as a hydrogen atmosphere, a nitrogen atmosphere, or an inert atmosphere such as an argon or helium atmosphere, whereby to provide a particularly desirable cathode.

Thus, according to one particularly desirable exemplification of the method of preparing a cathode according to this invention, the flame spray powder is prepared by mixing 90 grams of 0.5 to 15 micrometer Raney nickel-aluminum alloy power with 10 grams of 2 to 4 micrometer molybdenum powder and 10 to 15 grams of a spraying aid such as an amide of a fatty acid. The powder is then mixed, heated, broken up, and screened to obtain a minus 60 plus 250 mesh per inch fraction. One inch by four and three quarter inch by 13 guage steel perforated plate, which has previously been sandblasted and the perforations filled with a cement, is scraped with silicon carbide bar and then flame sprayed with an adherent material. Thereafter, 10 coats of the flame spray powder are applied by flame spraying with 45 volume percent oxygen 55 volume percent acetylene. The cathode surface is then cooled, and leached in 0.5 normal caustic followed by leaching in 1 normal caustic. The cathode may then be annealed at a temperature of 400° in argon and subsequently utilized as a cathode in an electrolytic cell.

According to a still further exemplification of the method of this invention, an electrolytic cell may be provided having an anode, and a cathode separated from the anode by a permionic membrane. The anode has a valve metal substrate with a suitable electroconductive, electrocatalytic surface thereon. By a valve metal is meant a material that forms an oxide when exposed to acidic liquors under anodic conditions, such as titanium, zirconium, hafnium, niobium, tantalum, or tungsten. By a suitable electroconductive surface is generally meant a surface having a chlorine evolution overvoltage of less than (0.1 volt) at a current density of 200 Amperes per square foot. Such surfaces include the titanium dioxide—ruthenium dioxide surfaces where the titanium dioxide is present in the rutile form which is isostructural with the ruthenium dioxide material.

The permionic membrane is typically a cation selective permionic membrane of the type described for example, in U.S. Pat. Nos. 3,718,627; 3,784,399; 3,882,093; and 4,065,366 having a perfluoro-alkyl backbone with pendant acid groups such as sulfonic acid groups, carboxylic acid groups, phosphonic acid groups, phosphoric acid groups, precursors thereof, or compounds thereof. The electrolytic cell herein contemplated further includes a cathode having an electroconductive substrate such as an iron substrate with a porous surface on the substrate, the porous surface having a major portion of nickel and an effective amount of molybdenum. The molybdenum may be elemental molybdenum, molybdenum carbide, molybdenum boride, molybdenum nitride, molybdenum sulfide, molybdenum oxide, or an alloy of molybdenum and nickel. The porous surface generally contains from about 10 to about 35 weight percent molybdenum, the balance being essentially nickel, with trace amounts of the leachable component, e.g., aluminum, also being present.

According to a still further exemplification of the method of this invention, alkali metal chloride brine for example, sodium chloride brine, containing about 320 to about 340 grams per liter of sodium chloride is fed to the anolyte compartment of the electrolytic cell. The anolyte liquor typically contains from about 125 to about 250 grams per liter of sodium chloride at a pH from about 2.5 to 4.5 and is separated from the alkaline catholyte liquor by permionic membrane. Electrical current passes from the anode to a cathode of the electrolytic cell whereby to evolve hydrogen at the cathode and hydroxyl ion in the catholyte liquor. The concentration of sodium hydroxide in the catholyte liquor is generally from about 15 to about 40 weight percent. The cathode herein contemplated, having an electroconductive substrate with a porous nickel-molybdenum surface thereon is utilized in the process of the invention.

The following examples are illustrative:

EXAMPLE 1

A cathode was prepared by flame spraying fine Raney Nickel-Aluminum alloy powder and fine molybdenum powder onto a perforated steel plate and leaching the flame sprayed surface with aqueous sodium hydroxide.

The flame spray power was prepared by mixing 90 grams of 0.5–20 micrometer Harshaw Raney Nickel-Aluminum alloy powder with 10 grams of 2 to 4 micrometer Cerac molybdenum powder, and twelve grams of Cerac "Spray Aid" ammonium stearate. The mixed powder was then heated to 110° C., where the mix turned gummy, but solidified upon cooling. The resulting solid was broken up in a mortar and pestle and screened to recover a minus 60 plus 250 mesh per inch fraction.

The steel plate, measuring 13 guage by 1.0 inch by $4\frac{3}{4}$ inches, was sandblasted. The perforations were then filled with a cement containing 3 parts of Dylon "C-10" refractory cement and 1 part of $H_3BO_3$, and the perforated plate was abraded with a silicon carbide bar. Thereafter the plate was flame sprayed with one coat of Eutectic Corp. Xuperbond nickel-aluminum bond coat.

Thereafter ten coats of the powder described above were applied by flame spraying with an oxygen-fuel mixture of 45 volume percent oxygen and 55 volume percent acetylene.

After cooling, the coating was leached in 0.5 normal NaOH for two hours at 25° C., then in 1.0 normal NaOH for fifteen minutes at 25° C. The cathode was then rinsed in water, blotted with a paper towel, and allowed to dry in air.

The cathode was then tested in an electrolytic cell where it was separated from the anode by a DuPont NAFION 715 perfluorcarbon-perfluorocarbon sulfonic acid microporous diaphragm spaced $2\frac{3}{8}$ inch (53 millimeters) from the cathode.

Electrolysis was carried out for 145 days. The cathode potential on the front surface of the cathode was between 1.139 and 1.154 volts, and the cathode potential on the back surface of the cathode was between 1.177 volts and 1.190 volts, at a current density of 200 amperes per square foot.

EXAMPLE II

A cathode was prepared by flame spraying coarse Raney nickel-aluminum alloy powder and molybdenum powder onto a perforated steel plate, and thereafter leaching the flame sprayed surface with aqueous sodium hydroxide.

The flame spray powder was prepared by mixing 90 grams of 1–70 micrometer Ventron Raney nickel alloy, 10 grams of Cerac 2 to 4 micrometer molybdenum powder and 12 grams of Cerac "Spray Aid" ammonium stearate. The powder was then heated, broken up, and screened as described in Example 1, above, to obtain a minus 60 plus 250 mesh per inch fraction.

A one inch by four and three-quarter inch by 13 guage steel perforated plate was sandblasted, the perforations filled with a cement of 3 parts of Dylon "C-10" refractory cement and one part of $H_3BO_3$. The surface of the plate was then scrapped with a silicon carbide bard, and then flame sprayed with Eutectic Corp. Xuperbond nickel-aluminum bond coat.

Thereafter ten coats of the powder described above were applied by flame spraying with an oxygen-fuel mixture of 45 volume percent oxygen and 55 volume percent acetylene. After spraying the cathode was cooled, and leached in NaOH as described above.

The cathode was then tested in an electrolytic cell where it was separated from the anode by a DuPont NAFION 715 microporous diaphragm spaced $2\frac{5}{8}$ inch (63 millimeters) from the cathode. Electrolysis was carried out for 95 days. The cathode potential on the front surface of the cathode was between 1.153 and 1.160 volts, and the cathode potential on the back surface of the cathode was between 1.179 and 1.189 volts at a current density of 200 amperes per square foot.

EXAMPLE III

A series of three cathodes were prepared to determine the effect of annealing on cathodic properties.

The flame spray powder prepared in Example I above, was utilized in preparing all of the cathodes for the tests.

Three perforated steel plates, each measuring four and three quarter inches by one inch by 13 guage were sandblasted, had their perforations filled, and had their surfaces scrapped with silicon carbide, and were precoated with Eutectic Corp. "Xuperbond", as described in Example II, above. Ten coats of the flame spray powder were applied to each plate as described in Example I, above. Thereafter, the cathodes were leached in aqueous sodium hydroxide, rinsed with water, and blotted, as described in Example I, above.

The cathodes were then annealed in a tube furnace having a gas source and a one and one half inch diameter by twelve inch long tubular heating element. The cathodes were individually annealed as shown in the Table, and thereafter utilized as cathodes. Each cathode was separated from an anode by a DuPont NAFION 715 diaphragm. The results obtained are shown in the Table.

TABLE

| Annealed Cathods | | | |
|---|---|---|---|
| Annealing Gas | $H_2$ | $H_2$ | Ar |
| Annealing Temperature | 200° C. | 400° C. | 400° C. |
| Annealing Time | 40 hours | 16 hours | 16 hours |
| Days of electrolysis | 35 | 71 | 71 |
| Cathode voltage, front surface | 1.174–1.180 | 1.171–1.75 | 1.157–1.159 |
| Cathode voltage, back surface | 1.196–1.212 | 1.193–1.214 | 1.179–1.195 |

(at 200 amperes per square foot).

EXAMPLE IV

A cathode was prepared by flame spraying Raney nickel-aluminum alloy powder and molydenum carbide powder onto a perforated steel plate, and leaching the flame sprayed steel surface with aqueous sodium hydroxide.

The flame spray powder was prepared by mixing 40 grams 1–70 micrometer Ventron Raney nickel-aluminum alloy, 10 grams of Starck-Berlin 1 micrometer molybdenum carbide alloy; and 6 grams of Cerac Spray-Aid ammonium stearate. The mixed powder was processed as described in Example I, above.

A perforated steel plate measuring $4\frac{3}{4}$ inches by 1 inch by 13 guage was sandblasted, its perforations filled with cement as described in Example 1 above, its surface scrapped with silicon carbide, as described in Example 1, above, and then flame sprayed with Eutectic Corp. "Xuper-Ultrabond 3500" nickel-aluminum bond coat. Thereafter, ten coats of the Raney nickel-molybdenum carbide powder mixture was flame sprayed onto the substrated with an oxygen-fuel mixture of 45 volume percent oxygen and 55 volume percent acetylene.

The surfaced cathode was cooled, leached with aqueous sodium hydroxide, rinsed with water, blotted, and dried as described in Example 1, above.

The resulting cathode was then tested for 39 days in a laboratory cell, as described in Example 1, above. The cathode potential of the front surface was 1.148 volts and the cathode potential of the back surface was 1.175–1.182 volts at a current density of 200 amperes per square foot.

While the invention has been described with reference to certain exemplifications and embodiments thereof, the invention is not to be so limited except as in the claims appended hereto.

What is claimed is:

1. A method of preparing an electrode having a porous surface on a metal substrate comprising:

(a) depositing an aqueous alkali metal hydroxide impermeable nickel film on the substrate;

(b) flame spraying particles comprising an alloy of nickel and aluminum and separate particles comprising molybdenum onto the nickel film; and (c) leaching out said aluminum whereby to form a porous surface consisting essentially of nickel and molybdenum atop the porous film.

2. The method of claim 1 wherein said molybdenum is chosen from the group consisting of elemental molybdenum, molybdenum carbide, molybdenum boride, molybdenum nitride, molybdenum oxide, molybdenum phosphide, and molybdenum sulfide.

3. The method of claim 1 wherein the nickel film is from about 20 to about 125 microns thick.

4. The method of claim 1 comprising electrodepositing the nickel film onto the metal substrate.

5. In a method of preparing an electrode having a porous surface on a metal substrate, comprising flame spraying particles of an alloy of nickel and aluminum onto the metal substrate, and thereafter leaching out the aluminum to form a porous nickel surface, the improvement comprising:

(a) first electroplating an aqueous alkali metal hydroxide impermeable nickel film on the substrate;

(b) thereafter flame spraying particles comprising molybdenum with the particles of nickel-aluminum alloy onto the electroplated substrate;

and (c) thereafter leaching out aluminum whereby to form a porous surface consisting essentially of nickel and molybdenum.

* * * * *